US006306573B1

(12) United States Patent
Horsten et al.

(10) Patent No.: US 6,306,573 B1
(45) Date of Patent: Oct. 23, 2001

(54) PRODUCTION PROCESS FOR A BENZOTRIAZOLE-CONTAINING THERMOGRAPHIC RECORDING MATERIAL WITH IMPROVED STABILITY AND IMAGE-TONE

(75) Inventors: Bartholomeus Horsten, Rumst; Johan Loccufier, Zwijnaarde; Geert Defieuw, Bonheiden; Luc Leenders, Herentals, all of (BE)

(73) Assignee: Agfa-Gevaert (BE)

( * ) Notice: Subject to any disclaimer, the term of this patent is extended or adjusted under 35 U.S.C. 154(b) by 0 days.

(21) Appl. No.: 09/459,933

(22) Filed: Dec. 13, 1999

Related U.S. Application Data

(63) Continuation of application No. 08/856,097, filed on May 14, 1997, now Pat. No. 6,030,764.

(30) Foreign Application Priority Data

May 21, 1996 (DE) ..... EP 96201376

(51) Int. Cl.[7] ..... G03C 1/498

(52) U.S. Cl. ..... 430/617; 430/350; 430/613; 503/210

(58) Field of Search ..... 430/617, 619, 430/613, 350; 427/125; 503/210

(56) References Cited

U.S. PATENT DOCUMENTS 5,422,234 6/1995 Bauer et al. .
5,424,182 6/1995 Marginean, Sr. et al. .

FOREIGN PATENT DOCUMENTS

WO 9610213 4/1996 (WO) .

*Primary Examiner*—Thorl Chea
(74) *Attorney, Agent, or Firm*—Leydig, Voit, & Mayer, LTD

(57) ABSTRACT

A recording material comprising a support, a thermosensitive element and a protective layer therefor, the thermosensitive element comprising a substantially light-insensitive organic silver salt, an organic reducing agent therefor in thermal working relationship therewith and a binder, wherein the thermosensitive element further comprises in reactive association with the substantially light-insensitive organic silver salt and the organic reducing agent a substituted, exclusive of groups having an exclusively electron withdrawing character, or unsubstituted compound with an unsaturated 5-membered heterocyclic ring annulated with an aromatic ring system, the ring consisting of nitrogen and carbon atoms with at least one of the nitrogen atoms having a hydrogen atom and none of the carbon atoms being directly linked to a sulfur atom or being part of a carbonyl-group; a production process therefor and a thermal image recording process utilizing the recording-material.

10 Claims, No Drawings

PRODUCTION PROCESS FOR A BENZOTRIAZOLE-CONTAINING THERMOGRAPHIC RECORDING MATERIAL WITH IMPROVED STABILITY AND IMAGE-TONE

This is a continuation of U.S. application Ser. No. 08/856,097, filed May 14, 1997, U.S. Pat. No. 6,030,764.

FIELD OF THE INVENTION

The present invention relates to a thermographic material with a protective layer suitable for thermal development. In particular, it concerns improvements in the stabilization thereof.

BACKGROUND OF THE INVENTION.

Thermal imaging or thermography is a recording process wherein images are generated by the use of imagewise modulated thermal energy.

A survey of "direct thermal" imaging methods is given e.g. in the book "Imaging Systems" by Kurt I. Jacobson-Ralph E. Jacobson, The Focal Press—London and New York (1976), Chapter VII under the heading "7.1 Thermography". Direct thermal thermography is concerned with materials which are substantially not photosensitive, but are sensitive to heat or thermosensitive. Imagewise applied heat is sufficient to bring about a visible change in a thermosensitive imaging material.

Most of the "direct" thermographic recording materials are of the chemical type. On heating to a certain conversion temperature, an irreversible chemical reaction takes place and a coloured image is produced.

According to U.S. Pat. No. 3,080,254 a typical heat-sensitive (thermographic) copy paper includes in the heat-sensitive layer a thermoplastic binder, e.g ethyl cellulose, a water-insoluble silver salt, e.g. silver stearate and an appropriate organic reducing agent, of which 4-methoxy-1-hydroxy-dihydronaphthalene is a representative. Localized heating of the sheet in the thermographic reproduction process, or for test purposes by momentary contact with a metal test bar heated to a suitable conversion temperature in the range of about 90–150° C., causes a visible change to occur in the heat-sensitive layer. The initially white or lightly coloured layer is darkened to a brownish appearance at the heated area. In order to obtain a more neutral colour tone a heterocyclic organic toning agent such as phthalazinone is added to the composition of the heat-sensitive layer. Thermo-sensitive copying paper is used in "front-printing" or "back-printing" using infra-red radiation absorbed and transformed into heat in contacting infra-red light absorbing image areas of an original as illustrated in FIGS. 1 and 2 of U.S. Pat. No. 3,074,809.

DOS 2 400 224 and U.S. Pat. No. 3,708,378 each disclose in its example 1 the incorporation of benzotriazole in the thermosensitive element of a thermographic recording material comprising silver behenate, methyl gallate as co-reactant and tetrachlorophthalic acid anhydride.

WO 94/16361 discloses a multilayer heat-sensitive material for direct thermal recording for which no intermediate drying of organic noble metal salts is necessary and which is coatable from aqueous dispersions. This material comprises: a colour-forming amount of finely divided, solid colourless noble metal or iron salt of an organic acid distributed in a carrier composition; a color-developing amount of a cyclic or aromatic organic reducing agent, which at thermal copy and printing temperatures is capable of a colour-forming reaction with said noble metal or iron salt; and an image toning agent; characterized in that (a) the carrier composition comprises a substantially water-soluble polymeric carrier and a dispersing agent for the noble metal or iron salt and (b) the material comprises a protective overcoating layer for the colour-forming layer. This patent application also discloses that suitable antifoggants for use in the invention are well-known photographic antifoggants such as 2-mercaptobenzo-triazole, chromate, oxalate, carbonate, benzotriazole (BZT), 5-methylbenzotriazole, 5,6-dimethylbenzotriazole, 5-bromobenzotriazole, 5-chlorobenzo-triazole, 5-nitrobenzotriazole, 4-nitro-6-chlorobenzotriazole, 5-nitro-6-chlorobenzotriazole, 4-hydroxy-6-methyl-1,3,3a,7-tetraaza-indene, benzimidazole, 2-methylbenzimidazole, 5-nitrobenzimidazole, 1-phenyl-5-mercaptotetrazole (PMT), 2-mercaptobenzimidazole, 2-mercaptobenzothiazole, 2-mercaptobenzoxazole, 2-mercaptothiazoline, 2-mercapto-4-methyl-6,6'-dimethylpyrimidine, 1-ethyl-2-mercapto-5-amino-1,3,4-triazole, 1-ethyl-5-mercapto-1,2,3,4-tetrazole, 2,5-dimercapto-1,3,4-thiodiazole, 2-mercapto-5-amino-1,3,4-thiodiazole, dimethyldithiocarbamate, and diethyldithiocarbamate. Only mercaptobenzotriazole is used as an antifoggant in the examples of WO 94/16361.

Black monochrome images obtained with state of the art direct thermal recording materials, utilizing oxidation-reduction image-forming processes based on substantially light-insensitive organic silver salts and reducing agents therefor and having a protective layer to avoid image damage during image-wise application of heat to the material, in general exhibit a brownish tone and a non-neutral background when viewed using a viewbox, both of which becoming more pronounced upon storage making such materials unacceptable for medical applications. Furthermore, medical applications require prints with long term stability for legal reasons. The colour neutrality of black monochrome images can be quantified by spectrophotometric measurements according to ASTM Norm E179-90 in a R(45/0) geometry with evaluation according to ASTM Norm E308-90 to produce the CIELAB a* and b* coordinates and the colour neutrality of the maximum density can be quantified using the numerical colour value (NCV). The NCV value is defined as:

$$NCV = \frac{D_1 \times D_2}{(D_3)^2}$$

where $D_1$, $D_2$ and $D_3$ are lowest, next highest and highest respectively of the optical densities measured with a MacBeth™ TR924 densitometer through blue, green and red filters. The larger the NCV value the better the colour neutrality, with maximal colour neutrality corresponding to a NCV-value of 1.

There is a need for direct thermal recording materials capable of producing images with a more neutral image colour and a more neutral image background which are maintained during storage and periodic viewing in transmission with a viewbox.

OBJECTS OF THE INVENTION

It is therefore an object of the invention to providing direct thermal imaging materials capable of producing black monochrome images with a more neutral image colour and a more neutral image background which are maintained during storage and periodic viewing in transmission with a viewbox.

It is a further object of the invention to obtain a black monochrome image with a background with a good colour neutrality as shown by CIELAB a* and b* coefficients.

It is a further object of the invention to obtain a black monochrome image with a maximum density with a good colour neutrality as shown by the NCV value.

It is a still further object to provide a process utilizing a recording material with a protective layer with improved light stabilization to obtain a black monochrome direct thermal image with a background with a good colour neutrality as shown by its CIELAB a* and b* coefficient and a maximum optical density with a good colour neutrality as shown by its NCV value.

Further objects and advantages of the invention will become apparent from the description hereinafter.

SUMMARY OF THE INVENTION

The above-mentioned objects are realized by a recording material comprising a support, a thermosensitive element and a protective layer therefor, the thermosensitive element comprising a substantially light-insensitive organic silver salt, an organic reducing agent therefor in thermal working relationship therewith and a binder, wherein the thermosensitive element further comprises in reactive association with the substantially light-insensitive organic silver salt and the organic reducing agent a substituted, exclusive of groups having an exclusively electron withdrawing character, or unsubstituted compound with an unsaturated 5-membered heterocyclic ring annulated with an aromatic ring system, the ring consisting of nitrogen and carbon atoms with at least one of said nitrogen atoms having a hydrogen atom and none of the carbon atoms being directly linked to a sulfur atom or being part of a carbonyl-group.

The above mentioned objects are also realised by a process for producing a recording material as described above comprising the steps of: (i) providing a support; (ii) coating the support with a thermosensitive element; and (iii) coating the thermosensitive element with a protective layer.

The above objects are also realized by a thermal image recording process comprising the steps of: (i) bringing an outermost layer of the recording material as described above into proximity with a heat source; (ii) applying heat from the heat source image-wise to the recording material while maintaining proximity to the heat source to produce an image; and (iii) removing the recording material from the heat source.

Preferred embodiments of the invention are disclosed in the dependent claims.

DETAILED DESCRIPTION OF THE INVENTION

According to a preferred embodiment a thermal image forming process, according to the present invention, is realized, wherein the heat source is a thermal head, in particular a thin film thermal head.

Unsaturated 5-membered Heterocyclic Ring Compound

According to a preferred embodiment of the recording material, according to the present invention, the 5-membered heterocyclic ring contains three nitrogen atoms.

According to particularly preferred embodiments of the present invention, the 5-membered heterocyclic ring compound is benzotriazole, 5-methylbenzotriazole or 6-methylbenzotriazole.

Groups having an exclusively electron withdrawing character means, for the purposes of the present invention, electron withdrawing groups such as nitro, carboxy, sulfo groups etc which have no electron donating character and can be additionally characterized by their influence on benzene ring substitution, their directing a second substituent to a position meta to the group with exclusively electron withdrawing character. Halide groups do not have an exclusively electron withdrawing character, having both an electron accepting and an electron donating character, and have a different influence on benzene ring substitution, directing a second substituent ortho or para to the halide group.

Preferred substituted, exclusive of groups having an exclusively electron withdrawing character, or unsubstituted compounds with an unsaturated 5-membered heterocyclic ring annulated with an aromatic ring system, the ring consisting of nitrogen and carbon atoms with at least one of the nitrogen atoms having a hydrogen atom and none of the carbon atoms being directly linked to a sulfur atom or being part of a carbonyl-group with superior stabilizing and image tone improving properties, according to the present invention, are:

S01: benzotriazole
S02: 5-methylbenzotriazole
S03: 6-methylbenzotriazole
S04: 5-chlorobenzotriazole
S05: 6-chlorobenzotriazole

Protective Layer

According to the present invention, the thermosensitive element is coated from an aqueous medium with a protective layer to avoid local deformation of the thermosensitive element and to improve resistance against abrasion.

The protective layer comprises a binder which is water-soluble or water dispersible. The binder may be hydrophobic or hydrophilic. Among the hydrophobic binders polycarbonates as described in EP-A 614 769 are particularly preferred. However, hydrophilic binders are preferred for the protective layer.

Suitable hydrophilic binders for the outermost layer are, for example, gelatin, polyvinylalcohol, cellulose derivatives or other polysaccharides, hydroxyethylcellulose, hydroxypropylcellulose etc., with hardenable binders being preferred and polyvinylalcohol being particularly preferred.

A protective layer according to the present invention may comprise in addition a thermomeltable particle optionally with a lubricant present on top of the protective layer as described in WO 94/11199. In a preferred embodiment at least one solid lubricant having a melting point below 150° C. and at least one liquid lubricant in a binder is present, wherein at least one of the lubricants is a phosphoric acid derivative. Examples of suitable lubricating materials are surface active agents, liquid lubricants, solid lubricants which do not melt during thermal development of the recording material, solid lubricants which melt (thermomeltable) during thermal development of the recording material or mixtures thereof. The lubricant may be applied with or without a polymeric binder. The surface active agents may be any agents known in the art such as carboxylates, sulfonates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol and fatty acids.

Such protective layers may also comprise particulate material, e.g. talc particles, optionally protruding from the protective outermost layer as described in WO 94/11198. Other additives can also be incorporated in the protective layer e.g. colloidal particles such as colloidal silica.

Crosslinking Agents for the Protective Layer

The protective layer according to the present invention may be crosslinked. Crosslinking can be achieved by using crosslinking agents such as described in WO 95/12495 for protective layers, e.g. tetra-alkoxysilanes, polyisocyanates, zirconates, titanates, melamine resins etc., with tetraalkoxysilanes such as tetramethylorthosilicate and tetraethylorthosilicate being preferred.

Matting Agents for the Protective Layer

The protective layer of the recording material according to the present invention may comprise a matting agent. Suitable matting agents are described in WO 94/11198 and include e.g. talc particles and optionally protrude from the outermost layer.

Lubricants for the Protective Layer

Solid or liquid lubricants or combinations thereof are suitable for improving the slip characteristics of the recording materials according to the present invention.

Solid lubricants which can be used according to the present invention are polyolefin waxes e.g. polypropylene waxes, ester waxes e.g. fatty acid esters, polyolefin-polyether block copolymers, amide waxes e.g. fatty acid amides, polyglycols e.g. polyethylene glycol, fatty acids, fatty alcohols, natural waxes and solid phosphoric acid derivatives.

Preferred solid lubricants are thermomeltable particles such as those described in WO 94/11199 e.g. fatty acid esters, polyolefin-polyether block copolymers and fatty acid amides. Preferred fatty acid esters are glycerine monostearate, glycerine monopalmitate and mixtures of glycerine monostearate and glycerine monopalmitate. Preferred fatty acid amides are selected from the group consisting of ethylenebisstearamide, stearamide, oleamide, myristamide and erucamide.

Liquid lubricants which can be used according to the present invention according to the present invention are fatty acid esters such as glycerine trioleate, sorbitan monooleate and sorbitan trioleate, silicone oil derivatives and phosphoric acid derivatives such as (mono[isotridecyl polyglycolether (3 EO)]phosphate), (mono[isotridecyl polyglycolether (6 EO)]phosphate), (mono[oleyl polyglycolether (7 EO)] phosphate) and (mono[oleyl polyglycolether (7 EO)] phosphate).

Thermosensitive Element

The thermosensitive element, according to the present invention, comprises a substantially light-insensitive organic silver salt and an organic reducing agent therefor in thermal working relationship therewith in reactive association with a substituted, exclusive of groups having an exclusively electron withdrawing character, or unsubstituted compound with an unsaturated 5-membered heterocyclic ring annulated with an aromatic ring system, the ring consisting of nitrogen and carbon atoms with at least one of the nitrogen atoms having a hydrogen atom and none of the carbon atoms being part of a thione- or carbonyl-group. The element may comprise a layer system in which the ingredients may be dispersed in different layers, with the proviso that all three ingredients are in reactive association with one another i.e. during the thermal development process the reducing agent and the compound with an unsaturated 5-membered heterocyclic ring annulated with an aromatic ring system must be present in such a way that they are able to diffuse to said substantially light-insensitive organic silver salt particles so that reduction of the organic silver salt to silver giving the desired image-tone can take place. Furthermore the compound with an unsaturated 5-membered heterocyclic ring annulated with an aromatic ring system must be present in such a way that the thermosensitive element can be stabilized against the influence of light.

Organic Silver Salts

Preferred organic silver salts according to the present invention are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, with silver behenate being particularly preferred. Such silver salts are also called "silver soaps". In addition silver dodecyl sulphonate described in U.S. Pat. No. 4,504,575; and silver di-(2-ethylhexyl)-sulfosuccinate described in EP-A 227 141, modified aliphatic carboxylic acids with thioether group as described e.g. in GB-P 1,111,492 and other organic silver salts as described in GB-P 1,439,478, e.g. silver benzoate and silver phthalazinone, may be used likewise to produce a thermally developable silver image. Further are mentioned silver imidazolates and the substantially light-insensitive inorganic or organic silver salt complexes described in U.S. Pat. No. 4,260,677.

Reducing Agents

Suitable organic reducing agents for the reduction of said substantially light-insensitive organic silver salts are organic compounds containing at least one active hydrogen atom linked to O, N or C, such as is the case with, aromatic di- and tri-hydroxy compounds; aminophenols; METOL (tradename); p-phenylenediamines; alkoxynaphthols, e.g. 4-methoxy-1-naphthol described in U.S. Pat. No. 3,094,41; pyrazolidin-3-one type reducing agents, e.g. PHENIDONE (tradename); pyrazolin-5-ones; indan-1,3-dione derivatives; hydroxytetrone acids; hydroxytetronimides; hydroxylamine derivatives such as for example described in U.S. Pat. No. 4,082,901; hydrazine derivatives; and reductones e.g. ascorbic acid; see also U.S. Pat. Nos. 3,074,809, 3,080,254, 3,094,417 and 3,887,378.

Among useful aromatic di- and tri-hydroxy compounds having at least two hydroxy groups in para- or ortho-position on the same aromatic nucleus, e.g. benzene nucleus, hydroquinone and hydroquinone derivatives, and catechol and catechol derivatives respectively.

Among the catechol-type reducing agents, i.e. reducing agents containing at least one benzene nucleus with two hydroxy groups (—OH) in ortho-position, the following are preferred: catechol; pyrogallol; 3-(3,4-dihydroxyphenyl) propionic acid; 1,2-dihydroxybenzoic acid; gallic acid; gallic acid esters e.g. methyl gallate, ethyl gallate and propyl gallate; tannic acid; 3,4-dihydroxy-benzoic acid esters; and polyhydroxy spiro-bis-indane compounds in particular the polyhydroxy-spiro-bis-indane compounds described in U.S. Pat. No. 3,440,049 and more especially 3,3,3',3'-tetramethyl-5,6,5',6'-tetrahydroxy-1,1'-spiro-bis-indane and 3,3,3',3'-tetramethyl-4,6,7,4',6',7'-hexahydroxy-1,1'-spiro-bis-indane. Particularly preferred catechol-type reducing agents, described EP-A 6920 733.

The silver image density depends on the coverage of the above defined reducing agent(s) and organic silver salt(s) and has to be preferably such that, on heating above 100° C., an optical density of at least 2.5 can be obtained. Preferably at least 0.10 moles of reducing agent per mole of organic silver salt is used.

Auxiliary Reducing Agents

The above mentioned reducing agents being considered as primary or main reducing agents may be used in conjunction with so-called auxiliary reducing agents. Such auxiliary reducing agents are e.g. sterically hindered phenols, that on heating become reactive partners in the reduction of the substantially light-insensitive organic silver salt such as silver behenate, such as described in U.S. Pat. No. 4,001,026; or are bisphenols, e.g. of the type described in U.S. Pat. No. 3,547,648. The auxiliary reducing agents may be present in the imaging layer or in a polymeric binder layer in thermal working relationship thereto.

Preferred auxiliary reducing agents are sulfonamidophenols as described in the periodical Research Disclosure, February 1979, item 17842, in U.S. Pat. Nos. 4,360,581 and 4,782,0047 and in EP-A 423 891.

Other auxiliary reducing agents that may be used in conjunction with the above mentioned primary reducing agents are organic reducing metal salts, e.g. stannous stearate described in U.S. Pat. Nos. 3,460,946 and 3,547,648.

Polycarboxylic Acids and Anhydrides Thereof

According to the recording material of the present invention the thermosensitive element may comprise in addition at least one polycarboxylic acid and/or anhydride thereof in a molar percentage of at least 20 with respect to all said organic silver salt(s) present and in thermal working relationship therewith. The polycarboxylic acid may be aliphatic (saturated as well as unsaturayed aliphatic and also cycloaliphatic) or an aromatic polycarboxylic acid. These acids may be substituted e.g. with alkyl, hydroxyl, nitro or halogen. They may be used in anhydride form or partially esterified on the condition that at least two free carboxylic acids remain or are available in the heat recording step.

Particularly suitable are saturated aliphatic dicarboxylic acids containing at least 4 carbon atoms, e.g.: succinic acid, glutaric acid, adipic acid, pimelic acid, suberic acid, azelaic acid, sebacic acid, nonane-dicarboxylic acid, decane-dicarboxylic acid, undecane-dicarboxylic acid.

Suitable unsaturated dicarboxylic acids are maleic acid, citraconic acid, itaconic acid and aconitic acid. Suitable polycarboxylic acids are citric acid and derivatives thereof, acetonedicarboxylic acid, iso-citric acid and α-ketoglutaric acid.

Preferred aromatic polycarboxylic acids are ortho-phthalic acid and 3-nitro-phthalic acid, tetrachlorophthalic acid, mellitic acid, (pyromellitic acid and trimellitic acid and the anhydrides thereof.

Film-forming Binders of the Thermosensitive Element

The film-forming binder of the thermosensitive element containing the substantially light-insensitive organic silver salt may be all kinds of natural, modified natural or synthetic resins or mixtures of such resins, wherein the organic silver salt can be dispersed homogeneously: e.g. cellulose derivatives such as ethylcellulose, cellulose esters, e.g. cellulose nitrate, carboxymethylcellulose, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof.

A particularly suitable polyvinyl butyral containing a minor amount of vinyl alcohol units is marketed under the trade name BUTVAR™ B79 of Monsanto USA and provides a good adhesion to paper and properly subbed polyester supports The binder to organic silver salt weight ratio is preferably in the range of 0.2 to 6, and the thickness of the recording layer is preferably in the range of 5 to 50 μm.

The above mentioned binders or mixtures thereof may be used in conjunction with waxes or "heat solvents" also called "thermal solvents" or "thermosolvents" improving the reaction speed of the redox-reaction at elevated temperature.

By the term "heat solvent" in this invention is meant a non-hydrolyzable organic material which is in solid state in the recording layer at temperatures below 50° C. but becomes a plasticizer for the recording layer in the heated region and/or liquid solvent for at least one of the redox-reactants, e.g. the reducing agent for the organic silver salt, at a temperature above 60° C.

Toning Agents

In order to obtain a neutral black image tone in the higher densities and neutral grey in the lower densities the recording layer contains preferably in admixture with said organic silver salts and reducing agents a so-called toning agent known from thermography or photo-thermography.

Suitable toning agents are the phthalimides and phthalazinones within the scope of the general formulae described in U.S. Pat. No. 4,082,901. Further reference is made to the toning agents described in U.S. Pat. Nos. 3,074,809, 3,446,648 and 3,844,797. Other particularly useful toning agents are the heterocyclic toner compounds of the benzoxazine dione or naphthoxazine dione type are described in GB-P 1,439,478 and U.S. Pat. No. 3,951,660.

A toner compound particularly suited for use in combination with polyhydroxy benzene reducing agents is benzol [e][1,3]oxazine-2,4-dione described in U.S. Pat. No. 3,951,660.

Other Ingredients

The recording layer may contain in addition to the ingredients mentioned above other additives such as free fatty acids, surface-active agents, antistatic agents, e.g. non-ionic antistatic agents including a fluorocarbon group as e.g. in $F_3C(CF_2)_6CONH(CH_2CH_2O)$—H, silicone oil, e.g. BAYSILON™ Öl A (from BAYER AG, GERMANY), ultraviolet light absorbing compounds, white light reflecting and/or ultraviolet radiation reflecting pigments and/or optical brightening agents.

Support

The support for the thermal imaging material according to the present invention may be transparent, translucent or opaque, e.g. having a white light reflecting aspect and is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. For example, a paper base substrate is present which may contain white reflecting pigments, optionally also applied in an interlayer between the recording material and said paper base substrate.

The support may be in sheet, ribbon or web form and subbed if need be to improve the adherence to the thereon coated thermosensitive recording layer. The support may be made of an opacified resin composition, e.g. polyethylene terephthalate opacified by means of pigments and/or microvoids and/or coated with an opaque pigment-binder layer, and may be called synthetic paper, or paperlike film; information about such supports can be found in EP's 194 106 and 234 563 and U.S. Pat. Nos. 3,944,699, 4,187,113, 4,780,402 and 5,059,579. Should a transparent base be used, said base may be colourless or coloured, e.g. having a blue colour.

One or more backing layers may be provided to control physical properties such as curl and static.

Antistatic Layer

In a preferred embodiment the recording material of the present invention an antistatic layer is applied to the outermost layer not comprising at least one solid lubricant having a melting point below 150° C. and at least one liquid lubricant in a binder, wherein at least one of said lubricants is a phosphoric acid derivative.

Coating

The coating of any layer of the recording material of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Processing Configurations

Thermographic imaging is carried by the image-wise application of heat either in analogue fashion by direct exposure through an image or by reflection from an image or in digital fashion pixel by pixel either by using an infra-red heat source, for example with a Nd-YAG laser or other infra-red laser, or direct thermal imaging with a thermal head.

As described in "Handbook of Imaging Materials", edited by Arthur S. Diamond—Diamond Research Corporation—Ventura, Calif., printed by Marcel Dekker, Inc. 270 Madison Avenue, New York, N.Y. 10016 (1991), p. 498–502 in thermal printing image signals are converted into electric pulses and then through a driver circuit selectively transferred to a thermal printhead. The thermal printhead consists of microscopic heat resistor elements, which convert the electrical energy into heat via Joule effect. The electric pulses thus converted into thermal signals manifest themselves as heat transferred to the surface of the thermal paper wherein the chemical reaction resulting in colour development takes place. The operating temperature of common thermal printheads is in the range of 300 to 400° C. and the heating time per picture element (pixel) may be 50 ms or less, the pressure contact of the thermal printhead with the recording material being e.g. 100–500 g/cm$^2$ to ensure a good transfer of heat.

In a particular embodiment of the method according to the present invention the direct thermal image-wise heating of the recording material proceeds by Joule effect heating in that selectively energized electrical resistors of a thermal head array are used in contact or close proximity with said recording layer. Suitable thermal printing heads are e.g. a Fujitsu Thermal Head (FTP-040 MCS001), a TDK Thermal Head F415 HH7-1089 and a Rohm Thermal Head KE 2008-F3.

The image signals for modulating the current in the micro-resistors of a thermal printhead are obtained directly e.g. from opto-electronic scanning devices or from an intermediary storage means, e.g. magnetic disc or tape or optical disc storage medium, optionally linked to a digital image work station wherein the image information can be processed to satisfy particular needs.

Activation of the heating elements can be power-modulated or pulse-length modulated at constant power.

When used in thermographic recording operating with thermal printheads said recording materials will not be suited for reproducing images with fairly large number of grey levels as is required for continuous tone reproduction.

According to EP-A 622 217 relating to a method for making an image using a direct thermal imaging element, improvements in continuous tone reproduction are obtained by heating the thermal recording element by means of a thermal head having a plurality of heating elements, characterized in that the activation of the heating elements is executed line by line with a duty cycle Δ representing the ratio of activation time to total line time in such a way that the following equation is satisfied:

$$P \leqq P_{max} = 3.3\ W/mm^2 + (9.5\ W/mm^2 \times \Delta)$$

wherein $P_{max}$ is the maximal value over all the heating elements of the time averaged power density P (expressed in $W/mm^2$) dissipated by a heating element during a line time.

Direct thermal imaging can be used for both the production of transparencies and reflection type prints. Application of the present invention is envisaged in the fields of both graphics images requiring high contrast images with a very steep print density applied dot energy dependence and continuous tone images requiring a weaker print density applied dot energy dependence, such as required in the medical diagnostic field. In the hard copy field recording materials on a white opaque base are used, whereas in the medical diagnostic field black-imaged transparencies are widely used in inspection techniques operating with a light box.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appending claims.

The invention is illustrated hereinafter by way of invention examples and comparative examples. The percentages and ratios given in these examples are by weight unless otherwise indicated. The ingredients used in the invention and comparative examples are:

as organic silver salt: silver behenate represented in the examples by AgBeh;

as binder: polyvinyl butyral (BUTVAR™ B79) represented in the examples by PVB;

as reducing agent: ethyl 3,4-dihydroxybenzoate represented by R1;

as toning agents:
benzo[e][1,3]oxazine-2,4-dione represented by TA1;

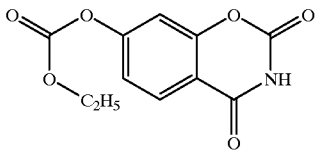

represented by TA2;

as levelling agent: silicone oil (Baysilone™ from Bayer AG) represented by oil;

as stabilizers:
tetrachlorophthalic anhydride represented by S1;
adipic acid represented by S2;

and in the comparative examples the following ingredients to define better the present invention:

C01: 5-nitrobenzimidazole an unsaturated 5-membered heterocyclic ring consisting of nitrogen and carbon atoms annulated with, a substituted benzene ring and having a nitrogen with a hydrogen atom, but with an electron withdrawing substituent C02: 2-mercapto-benzimidazole an unsaturated 5-membered heterocyclic ring consisting of nitrogen and carbon atoms annulated with a unsubstituted benzene ring without a nitrogen with a hydrogen atom and substituted with a —SH group C03: 2-amino-5-mercapto-1,3,4-thiadiazole an unsaturated 5-membered heterocyclic ring with a sulphur ring atom substituted with a —SH group

INVENTION EXAMPLES 1 TO 6 AND COMPARATIVE EXAMPLES 1 to 7

A subbed polyethylene terephthalate support having a thickness of 175 μm was doctor blade-coated from a coating composition containing butanone as a solvent and the following ingredients so as to obtain thereon, after drying for 1 hour at 50° C., thermosensitive elements with the compositions given in table 1 for comparative examples 1 to 9 and invention examples 1 to 4.

TABLE 1

| | Additional ingredient | | | | | | | | | |
|---|---|---|---|---|---|---|---|---|---|---|
| | number | quantity [g/m²] | AgBeh [g/m²] | PVB [g/m²] | R1 [g/m²] | TA1 [g/m²] | TA2 [g/m²] | Oil [g/m²] | S1 [g/m²] | S2 [g/m²] |
| Comparative example number | | | | | | | | | | |
| 1 | — | — | 4.95 | 18.89 | 0.969 | 0.259 | 0.133 | 0.042 | 0.151 | 0.404 |
| 2 | C01 | 0.052 | 5.03 | 19.19 | 0.985 | 0.263 | 0.135 | 0.043 | 0.154 | 0.410 |
| 3 | C01 | 0.171 | 4.90 | 18.69 | 0.959 | 0.256 | 0.131 | 0.042 | 0.150 | 0.399 |
| 4 | C02 | 0.048 | 4.98 | 18.99 | 0.974 | 0.261 | 0.133 | 0.042 | 0.152 | 0.406 |
| 5 | C02 | 0.169 | 5.27 | 20.09 | 1.031 | 0.276 | 0.141 | 0.045 | 0.161 | 0.429 |
| 6 | C03 | 0.043 | 5.06 | 19.29 | 0.990 | 0.265 | 0.135 | 0.043 | 0.155 | 0.412 |
| 7 | C03 | 0.142 | 4.98 | 18.99 | 0.974 | 0.261 | 0.133 | 0.042 | 0.152 | 0.406 |

TABLE 1-continued

| | Additional ingredient | | | | | | | | | |
|---|---|---|---|---|---|---|---|---|---|---|
| | number | quantity [g/m²] | AgBeh [g/m²] | PVB [g/m²] | R1 [g/m²] | TA1 [g/m²] | TA2 [g/m²] | Oil [g/m²] | S1 [g/m²] | S2 [g/m²] |
| Invention example number | | | | | | | | | | |
| 1 | S01 | 0.039 | 5.06 | 19.29 | 0.990 | 0.265 | 0.135 | 0.043 | 0.155 | 0.412 |
| 2 | S01 | 0.134 | 5.24 | 19.99 | 1.026 | 0.274 | 0.140 | 0.045 | 0.160 | 0.427 |
| 3 | S02 | 0.043 | 5.03 | 19.19 | 0.985 | 0.263 | 0.135 | 0.043 | 0.154 | 0.410 |
| 4 | S02 | 0.146 | 5.13 | 19.59 | 1.005 | 0.269 | 0.138 | 0.044 | 0.157 | 0.419 |
| 5 | S04 | 0.050 | 5.11 | 19.49 | 1.000 | 0.267 | 0.137 | 0.043 | 0.156 | 0.417 |
| 6 | S04 | 0.165 | 5.06 | 19.29 | 0.990 | 0.265 | 0.135 | 0.043 | 0.155 | 0.412 |

Protective Layer

The thermosensitive element was then coated with an aqueous composition. The pH of the coating composition was adjusted to a pH 4 by adding 1N nitric acid. Those lubricants which were insoluble water, were dispersed in a ball mill with, if necessary, the aid a dispersion agent. The composition was coated to a wet layer thickness of 85μm and then dried at 40° C. for 15 minutes and hardened 57° C. and a relative humidity of 34% for 2 days to produce a layer with the following composition expressed as the coating weight of ingredients present:

| | |
|---|---|
| polyvinylalcohol (Mowiviol ™ WX 48 20, Wacker Chemie): | 4.9 g/m² |
| dispersion agent (Ultravon ™ W from Ciba Geigy)*: | 0.075 g/m² |
| colloidal silica (Levasil ™ VP AC 4055 from Bayer AG, a 15% aqueous dispersion of colloidal silica): | 1.05 g/m² |
| mono[isotridecyl polyglycolether (3 EO)] phosphate (Servoxyl ™ VPDZ 3/100 from Servo Delden): | 0.075 g/m² |
| mixture of monolauryl and diluaryl phosphates (Servoxyl VPAZ 100 from Servo Delden): | 0.075 g/m² |
| talc (Steamic ™ OOS from Talc de Lusenac): | 0.045 g/m² |
| porous silica (Syloid ™ 72 from Grace): | 0.09 g/m² |
| glycerine monotallow acid ester (Rilanit ™ GMS from Henkel): | 0.15 g/m² |
| tetramethylorthosilicate (hydrolyzed in the presence of methanesulfonic acid): | 0.87 g/m² |

*converted into acid form by passing through an ion exchange column.

The printer was equipped with a thin film thermal head with a resolution of 300 dpi and was operated with a line time of 19 ms (the line time being the time needed for printing one line). During said line time the print head received constant power. The average printing power, being the total amount of electrical input energy during one line time divided by the line time and by the surface area of the heat-generating resistors was 1.5 mJ/dot being sufficient to obtain maximum optical density in each of said recording materials.

Image Evaluation

The optical maximum and minimum densities of the prints given in table 2 were measured through a visual filter with a Macbeth™ TR924 densitometer in the grey scale step corresponding to data levels of 255 and 0 respectively.

The colour neutrality the optical density (D) of these images was evaluated by measuring the optical densities through blue, green and red filters using a MacBeth™ TR924 densitometer. The lowest, next highest and highest optical densities were assigned to $D_1$, $D_2$ and $D_3$ respectively and were used to obtain a numerical colour value (NCV) by substituting the corresponding values in the following equation:

$$NCV = \frac{D_1 \times D_2}{(D_3)^2}$$

Maximal colour neutrality corresponds to a NCV value of 1. The larger the NCV value the better the colour neutrality of the image obtained. NCV values were determined at optical densities (D) with a visual filter of 1, 2 and 3 for the fresh materials and for the same materials after being heated at 57° C. in a relative humidity of 34% for 3 days for the materials of comparative examples 1 to 5 and invention examples 1 to 8 and the NCV-values obtained summarized in table 2. The NCV-values in table 2 enable materials with different stabilizing compounds at different concentrations to be compared on the basis of their colour neutrality, the dependence of their colour neutrality upon image optical density and the pre-exposure evolution in colour neutrality.

TABLE 2

| | image characteristics printing with fresh material | | | | | image characteristics printing after 3 days at 57° C. & 34% RH | | | | |
|---|---|---|---|---|---|---|---|---|---|---|
| | | NCV | | | | | NCV | | | |
| | $D_{max}$ vis | at D = 1 | at D = 2 | at D = 3 | $D_{min}$ vis | $D_{max}$ vis | at D = 1 | at D = 2 | at D = 3 | $D_{min}$ vis |
| Comparative example number | | | | | | | | | | |
| 1 | 3.18 | 0.80 | 0.81 | 0.79 | 0.10 | 3.22 | 0.77 | 0.74 | 0.87 | 0.10 |
| 2 | 3.10 | 0.83 | 0.89 | 0.91 | 0.10 | 3.08 | 0.81 | 0.83 | — | 0.09 |
| 3 | 2.84 | 0.84 | 0.92 | — | 0.10 | 2.77 | 0.81 | 0.88 | — | 0.10 |
| 4 | 2.88 | 0.84 | 0.91 | — | 0.10 | 2.64 | 0.80 | 0.87 | — | 0.10 |
| 5 | 2.18 | 0.84 | 0.87 | — | 0.09 | 2.29 | 0.81 | 0.85 | — | 0.09 |
| 6 | 3.00 | 0.81 | 0.84 | 0.82 | 0.10 | 2.89 | 0.80 | 0.83 | — | 0.10 |
| 7 | 2.44 | 0.71 | 0.66 | — | 0.09 | 2.36 | 0.71 | 0.68 | — | 0.10 |
| Invention example number | | | | | | | | | | |
| 1 | 3.01 | 0.85 | 0.90 | 0.94 | 0.10 | 3.05 | 0.81 | 0.87 | 0.89 | 0.10 |
| 2 | 2.80 | 0.87 | 0.97 | — | 0.10 | 2.78 | 0.87 | 0.94 | — | 0.10 |
| 3 | 3.07 | 0.84 | 0.90 | 0.94 | 0.10 | 3.13 | 0.80 | 0.84 | 0.87 | 0.10 |
| 4 | 2.73 | 0.88 | 0.96 | — | 0.09 | 2.93 | 0.85 | 0.89 | — | 0.09 |
| 5 | 3.08 | 0.82 | 0.89 | 0.92 | 0.10 | 3.21 | 0.81 | 0.83 | 0.84 | 0.09 |
| 6 | 2.66 | 0.88 | 0.95 | — | 0.09 | 2.66 | 0.87 | 0.89 | — | 0.09 |

It is evident from table 2 that with the exception of the material of comparative examples 1, 6 and 7 without a stabilizing compound and with stabilizing compound C03, all fresh materials of comparative examples 1 to 7 and invention examples 1 to 6 formed images with excellent colour neutralities i.e. NCV-values of about 0.90 and that there was also no significant difference in the NCV-values after thermal treatment for 3 days at 57° C. and 34% relative humidity.

The stability of the image background of the materials of comparative examples 1 to 7 and invention examples 1 to 6 to post-image development exposure was evaluated by first thermally treating the materials for 3 days at 57° C. and 34% relative humidity, next producing images in the materials by image-wise thermal development and finally exposing the images formed in the materials for 3 days on top of the white PVC window of a specially constructed light-box placed in a Votsch conditioning cupboard set at 30° C. and a relative humidity of 85%. Only a central area of the window 550 mm long by 500 mm wide was used for mounting the test materials to ensure uniform exposure.

The stainless steel light-box used was 650 mm long, 600 mm wide and 120 mm high with an opening 610 mm long and 560 mm wide with a rim 10 mm wide and 5 mm deep round the opening, thereby forming a platform for a 5 mm thick plate of white PVC 630 mm long and 580 mm wide, making the white PVC-plate flush with the top of the light-box and preventing light loss from the light-box other than through the white PVC-plate. This light-box was fitted with 9 Planilux™ TLD 36 W/54 fluorescent lamps 27 mm in diameter mounted length-wise equidistantly from the two sides, with the lamps positioned. equidistantly to one another and the sides over the whole width of the light-box and with the tops of the fluorescent tubes 30 mm below the bottom of the white PVC plate and 35 mm below the materials being tested.

The suitability of a material was assessed on the basis of the initial background density determined through a blue filter using a MacBeth™ TR924 densitometer, the background density through a blue filter after exposure in the lightbox for 3 days at 30° C. and 85% relative humidity and the L*, a* and b* CIELAB-values of the background after 3 days and 6 days exposure in the lightbox at 30° C. and 85% relative humidity. The L*, a* and b* CIELAB-values of the background were determined by spectrophotometric measurements according to ASTM Norm E179-90 in a R(45/0) geometry with evaluation according to ASTM Norm E308-90. The $D_{min}$-values before lightbox exposure and after 3 days lightbox exposure and the L*, a*, and b* CIELAB-values after 3 days lightbox exposure for the materials of comparative examples 1 to 7 and invention examples 1 to 6 thermally pretreated for 3 days at 57° C. and 34% relative humidity are summarized in table 3.

Colour neutrality on the basis of CIELAB-values corresponds to a* and b* values of zero, with a negative a*-value indicating a greenish image-tone becoming greener as a* becomes more negative, a positive a*-value indicating a reddish image-tone becoming redder as a* becomes more positive, a negative b*-value indicating a bluish image-tone becoming bluer as b* becomes more negative and a positive b* -value indicating a yellowish image-tone becoming yellower as b* becomes more positive.

TABLE 3

| Colour neutrality of background | | | | | |
|---|---|---|---|---|---|
| | $D_{min}$* | After 72 h exposure in lightbox at 30° C. & 85% RH CIELAB values | | | |
| | pre-exposure | $D_{min}$* | L* | a* | b* |
| Comparative example number | | | | | |
| 1 | 0.12 | 0.15 | 81.98 | −3.07 | 20.82 |
| 2 | 0.13 | 0.16 | 82.88 | −0.92 | 20.06 |
| 3 | 0.14 | 0.16 | 84.13 | −1.57 | 18.91 |
| 4 | 0.14 | 0.18 | 80.44 | 0.76 | 28.90 |
| 5 | 0.12 | 0.17 | 77.74 | 4.46 | 32.18 |
| 6 | 0.13 | 0.15 | 80.59 | −0.61 | 28.83 |
| 7 | 0.13 | 0.14 | 77.70 | 0.53 | 37.68 |
| Invention example number | | | | | |
| 1 | 0.12 | 0.14 | 85.72 | −2.96 | 14.75 |
| 2 | 0.12 | 0.14 | 86.94 | −2.65 | 11.45 |
| 3 | 0.12 | 0.15 | 85.55 | −3.2 | 15.43 |
| 4 | 0.12 | 0.13 | 86.87 | −2.45 | 10.06 |
| 5 | 0.12 | 0.15 | 85.09 | −3.04 | 16.89 |
| 6 | 0.11 | 0.13 | 86.14 | −2.31 | 12.93 |

*through a blue filter after 3 d at 57° C. & 34% RH

The results in table 3 for the materials of comparative examples 2 to 5 exhibit significantly higher $D_{min}$-values after 3 days lightbox exposure than those for comparative examples 1, 6 and 7 and invention examples 1 to 6 after 3 days lightbox.

As regards the colour neutrality of the background, the degree of transparency of the materials of invention examples 1 to 6, as indicated by their L*-values, at 24 85 was significantly higher than that of the materials of comparative examples 1 to 7 which varied between 77 and 84. Furthermore, the b*-values of the materials of invention examples 1 to 6 were much lower at ≦15.43 i.e. much less yellow than those of the materials of comparative examples 1 to 7, which varied between 18.91 and 37.68.

Comparative examples 1 to 7 show by comparison with invention examples 1 to 6 that recording materials comprising a thermosensitive element comprising a substituted, exclusive of groups having an exclusively electron withdrawing character, or unsubstituted compound with an unsaturated 5-membered heterocyclic ring annulated with an aromatic ring system, said ring consisting of nitrogen and carbon atoms with at least one of said nitrogen atoms having a hydrogen atom and none of said carbon atoms being part of a thione- or carbonyl-group exhibit images with superior stability and/or images with superior colour neutrality and/or an image background with superior colour neutrality compared with materials without such compounds (comparative example 1), with materials with C01, an unsaturated 5-membered heterocyclic ring consisting of nitrogen and carbon atoms annulated with a substituted benzene ring and having a nitrogen with a hydrogen atom, but with an exclusively electron withdrawing substituent (comparative examples 2 and 3), with materials with C02, an unsaturated 5-membered heterocyclic ring consisting of nitrogen and carbon atoms annulated with a unsubstituted benzene ring without a nitrogen with a hydrogen atom and substituted with a —SH group (comparative examples 4 and 5) and with materials with C03, an unsaturated 5-membered heterocyclic ring with a sulphur ring atom substituted with a —SH group (comparative examples 6 and 7).

The compounds incorporated in the materials of invention examples 1 to 6 and comparative examples 2 to 7: compounds S01, S02, S04, C01, C02 and C03 are all to be found in the list of "suitable antifoggants" cited for use in the noble metal or iron salt of an organic acid/ cyclic or aromatic organic reducing agent-based thermographic materials of WO 94/16361:

S01: benzotriazole
S02: 5-methylbenzotriazole
S04: 5-chloro-benzotriazole
C01: 5-nitrobenzimidazole
C02: 2-mercapto-benzimidazole
C03: 2-amino-5-mercapto-1,3,4-thiadiazole However, materials incorporating one of the above compounds from the list of "suitable antifoggants" given in WO 94/16361 (comparative examples 5 and 6) exhibited poor NCV-values with fresh materials and materials subjected to 3 days at 57° C. and 34% relative humidity and also very poor colour neutrality of the background after 3 days exposure in a lightbox at 30° C. and 85% relative humidity. Materials incorporating two of the above compounds from the list of "suitable antifoggants" given in WO 94/16361 (comparative examples 2 to 4) exhibited excellent NCV-values with fresh materials and materials subjected to 3 days at 57° C. and 34% relative humidity, but very poor colour neutrality of the background after 3 days exposure in a lightbox at 30° C. and 85% relative humidity. On the other hand, materials incorporating three of the above compounds from the list of "suitable antifoggants" given in WO 94/16361 (invention examples 1 to 6) exhibited excellent NCV-values with fresh materials and materials subjected to 3 days at 57° C. and 34% relative humidity and also acceptable colour neutrality of the background after 3 days exposure in a lightbox at 30° C. and 85% relative humidity. This list of "suitable antifoggants" can not therefore be taken as a reliable predictor for antifoggants for materials of the present invention.

INVENTION EXAMPLES 7 AND 8 AND COMPARATIVE EXAMPLE 8

The recording materials of invention examples 7 and 8 and comparative example 8 were produced as described for invention examples 1 to 6 and comparative examples 1 to 7 except that the quantities of ingredients present in the materials were different. The recording material of comparative example 8 was produced as described for comparative example 1. The compositions of the thermosensitive elements are given in table 4.

TABLE 4

| | Additional ingredient | | | | | | | | | |
|---|---|---|---|---|---|---|---|---|---|---|
| | number | quantity [g/m²] | AgBeh [g/m²] | PVB [g/m²] | R1 [g/m²] | TA1 [g/m²] | TA2 [g/m²] | Oil [g/m²] | S1 [g/m²] | S2 [g/m²] |
| Comparative example number | | | | | | | | | | |
| 8 | — | — | 5.16 | 19.61 | 1.010 | 0.271 | 0.139 | 0.044 | 0.158 | 0.365 |
| Invention example number | | | | | | | | | | |
| 7 | S01 | 0.132 | 5.19 | 19.81 | 1.015 | 0.272 | 0.139 | 0.045 | 0.159 | 0.356 |
| 8 | S02 | 0.155 | 5.45 | 20.81 | 1.067 | 0.286 | 0.146 | 0.047 | 0.167 | 0.374 |

Thermographic printing and image evaluation were carried out on the resulting materials as described for invention examples 1 to 6 and comparative examples 1 to 7. The $D_{max}$-, $D_{min}$-, and NCV-values obtained with the materials of invention examples 7 and 8 and comparative example 10 are summarized in table 5.

TABLE 5

| | image characteristics printing with fresh material | | | | | image characteristics printing after 3 days at 57° C. & 34% RH | | | | |
|---|---|---|---|---|---|---|---|---|---|---|
| | | NCV | | | | | NCV | | | |
| | $D_{max}$ vis | at D = 1 | at D = 2 | at D = 3 | $D_{min}$ vis | $D_{max}$ vis | at D = 1 | at D = 2 | at D = 3 | $D_{min}$ vis |
| Comparative example number | | | | | | | | | | |
| 8 | 3.53 | 0.79 | 0.77 | 0.67 | 0.09 | 3.90 | 0.78 | 0.80 | 0.71 | 0.09 |
| Invention example number | | | | | | | | | | |
| 7 | 3.54 | 0.85 | 0.88 | 0.88 | 0.09 | 3.75 | 0.80 | 0.83 | 0.83 | 0.08 |
| 8 | 3.41 | 0.84 | 0.86 | 0.84 | 0.09 | 3.57 | 0.80 | 0.85 | 0.83 | 0.08 |

It is evident from table 5 that the image colour neutrality of the materials of the invention examples both fresh and after 3 days at 57° C. and 34% relative humidity were far superior to that of comparative example 8 without a stabilizing compound according to the present invention.

The results concerning the stability of the image background obtained as described for invention examples 1 to 6 and comparative examples 1 to 7 are summarized in table 6.

TABLE 6

| | Colour neutrality of background | | | | |
|---|---|---|---|---|---|
| | $D_{min}$* | After 72 h exposure in lightbox at 30° C. & 85% RH CIELAB values | | | |
| | pre-exposure | $D_{min}$* | L* | a* | b* |
| Comparative example number | | | | | |
| 8 | 0.13 | 0.15 | 83.10 | 0.86 | 15.24 |
| Invention example number | | | | | |
| 7 | 0.12 | 0.12 | 86.21 | 0.16 | 7.41 |
| 8 | 0.11 | 0.12 | 86.58 | −0.04 | 6.18 |

*through a blue filter after 3 d at 57° C. & 34% RH

Table 6 shows that the materials of the invention examples exhibit significantly lower $D_{min}$-values after 3 days lightbox exposure than that comparative examples 8 without a stabilizing compound according to the present invention. Furthermore, the materials of the invention examples also exhibit backgrounds with a much higher degree of colour neutrality as adjudged by their a*- and b*-values after 3 days and 6 days lightbox exposure than those of comparative example 8 without a stabilizing compound according to the present invention, the latter exhibiting a marked yellow tone.

Having described in detail preferred embodiments of the current invention, it will now be apparent to those skilled in the art that numerous modifications can be made therein without departing from the scope of the invention as defined in the following claims.

What is claimed is:

1. A recording material comprising a support, a thermosensitive element and a protective layer therefor, said thermosensitive element comprising a substantially light-insensitive organic silver salt of aliphatic carboxylic acid, an organic reducing agent therefor in thermal working relationship therewith and a binder, wherein said thermosensitive element further comprises, in reactive association with said substantially light-insensitive organic silver salt and said organic reducing agent, benzotriazole.

2. The recording material according to claim 1, wherein said substantially light-insensitive organic silver salt of aliphatic carboxylic acid is a substantially light-insensitive fatty acid silver salt.

3. The recording material according to claim 1, wherein the silver salt of aliphatic carboxylic acid is silver behenate.

4. A process for producing a recording material comprising the steps of (i) providing a support; (ii) coating said support with a thermosensitive element comprising a substantially light-insensitive organic silver salt of aliphatic carboxylic acid, an organic reducing agent therefor in thermal working relationship therewith and a binder; and (iii) coating said thermosensitive element with a protective layer, wherein said thermosensitive element further comprises, in reactive association with said substantially light-insensitive organic silver salt and said organic reducing agent, benzotriazole.

5. The process according to claim 4, wherein said thermosensitive element is coated from a non-aqueous medium.

6. The process according to claim 4, wherein said protective layer is coated from an aqueous medium.

7. The process according to claim 4, wherein the silver salt of aliphatic carboxylic acid is silver behenate.

8. A thermal image recording process comprising the steps of: (i) bringing an outermost layer of a recording material comprising a support, a thermosensitive element and a protective layer therefor, said thermosensitive element comprising a substantially light-insensitive organic silver salt of aliphatic carboxylic acid, an organic reducing agent therefor in thermal working relationship therewith and a binder into proximity with a heat source; (ii) applying heat from said heat source image-wise to said recording material while maintaining proximity to said heat source to wise to said recording material while maintaining proximity to said heat source to produce an image; and (iii) removing said recording material from the heat source, wherein said thermosensitive element further comprises, in reactive association with said substantially light-insensitive organic silver salt and said organic reducing agent, benzotriazole.

9. The thermal image recording process according to claim 8, wherein said heat source is a thermal head.

10. The process according to claim 8, wherein the silver salt of aliphatic carboxylic acid is silver behenate.

* * * * *